US007334607B2

(12) United States Patent
Bellott et al.

(10) Patent No.: US 7,334,607 B2
(45) Date of Patent: Feb. 26, 2008

(54) PROTECTIVE CAP FOR A SEALING STOPPER IN A COLLECTING VESSEL OF A CONDENSER

(75) Inventors: Frederic Bellott, Sarre-Union (FR); Fabrice Kaczmarek, Hambach (FR); Frederic Seibert-Sandt, Metz (FR)

(73) Assignee: Behr France Hambach, Hambach (FR)

( * ) Notice: Subject to any disclaimer, the term of this patent is extended or adjusted under 35 U.S.C. 154(b) by 0 days.

(21) Appl. No.: 10/541,553

(22) PCT Filed: Nov. 14, 2003

(86) PCT No.: PCT/EP03/12766

§ 371 (c)(1),
(2), (4) Date: Jun. 30, 2006

(87) PCT Pub. No.: WO2004/061376

PCT Pub. Date: Jul. 22, 2004

(65) Prior Publication Data

US 2006/0254659 A1 Nov. 16, 2006

(30) Foreign Application Priority Data

Jan. 7, 2003 (EP) ..... 03290037

(51) Int. Cl.
*F16L 55/10* (2006.01)

(52) U.S. Cl. ..... 138/89; 138/90; 220/237

(58) Field of Classification Search ..... 138/89, 138/96 R, 96 T, 90; 220/237
See application file for complete search history.

(56) References Cited

U.S. PATENT DOCUMENTS

| | | | | | |
|---|---|---|---|---|---|
| 2,366,975 | A * | 1/1945 | McChesney | 138/89 |
| 3,494,504 | A * | 2/1970 | Jackson | 220/237 |
| 3,765,456 | A * | 10/1973 | Karpenko | 138/89 |
| 4,170,247 | A * | 10/1979 | Bates | 138/89 |
| 4,384,655 | A | 5/1983 | Kendall | |
| 4,544,073 | A | 10/1985 | Willis | |
| 4,693,389 | A * | 9/1987 | Kalen | 220/236 |
| 5,038,830 | A * | 8/1991 | Arnaud | 138/89 |
| 5,062,325 | A * | 11/1991 | McCauley et al. | 81/436 |
| 5,307,841 | A * | 5/1994 | Condon | 138/90 |
| 5,419,141 | A | 5/1995 | Burk | |
| 6,349,562 | B1 * | 2/2002 | Kaspar et al. | 62/475 |
| 2001/0025511 | A1 | 10/2001 | Bernini | |

FOREIGN PATENT DOCUMENTS

| | | |
|---|---|---|
| CA | 944413 | 3/1974 |
| DE | 43 19 293 A1 | 12/1993 |
| DE | 100 39 260 A1 | 3/2001 |
| EP | 0 166 664 A2 | 1/1986 |
| EP | 0 204 503 A2 | 12/1986 |
| EP | 0 412 773 A1 | 2/1991 |
| EP | 1 104 879 A1 | 6/2001 |
| EP | 1 147 930 A1 | 10/2001 |
| FR | 2 111 327 | 6/1972 |
| GB | 2 366 363 A | 3/2002 |
| JP | 2001-033121 A | 2/2001 |

* cited by examiner

*Primary Examiner*—Patrick F. Brinson
(74) *Attorney, Agent, or Firm*—Foley & Lardner LLP

(57) ABSTRACT

The invention relates to a protective cap (9) for sealing a collecting vessel of a condenser closed by means of a sealing stopper (4).

24 Claims, 5 Drawing Sheets

Figure 1:
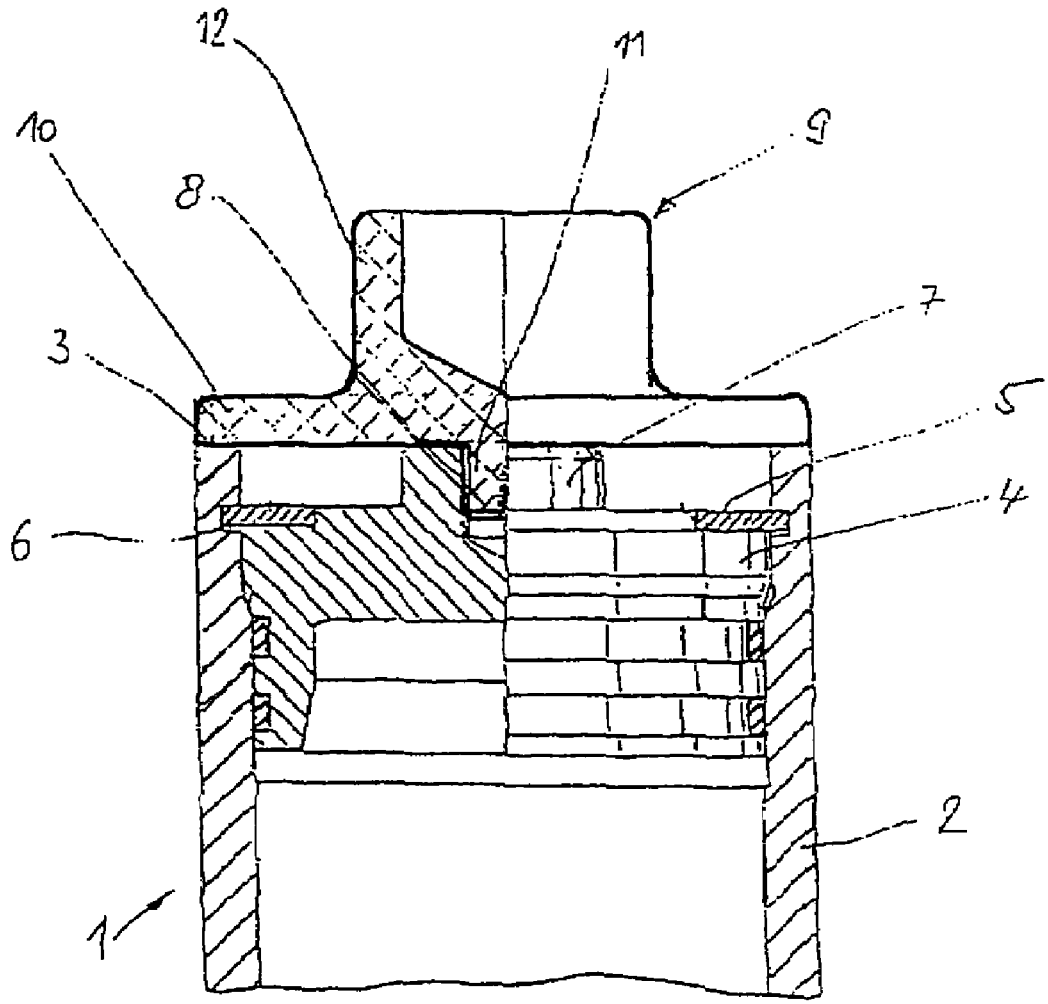

Fig. 2
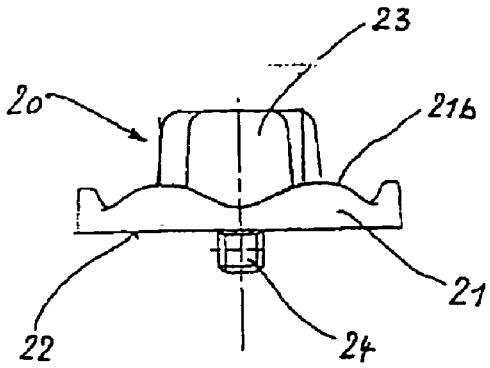
Fig. 2b
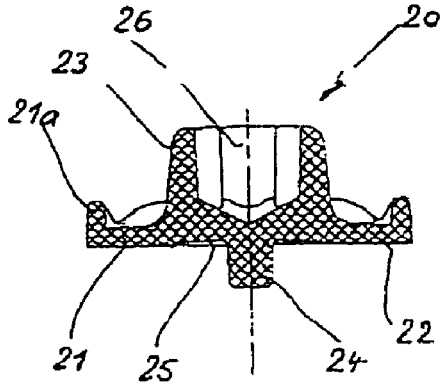
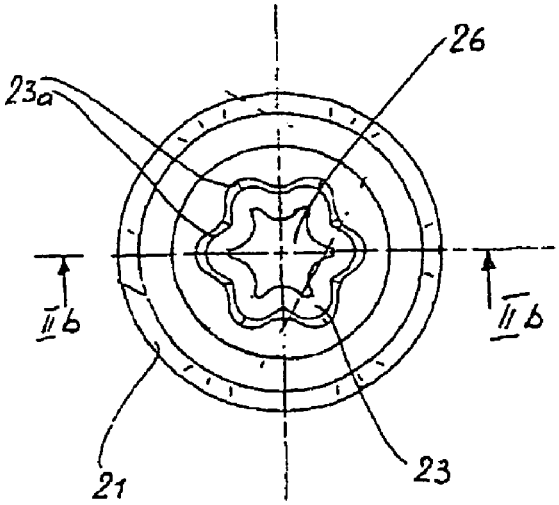
Fig. 2a
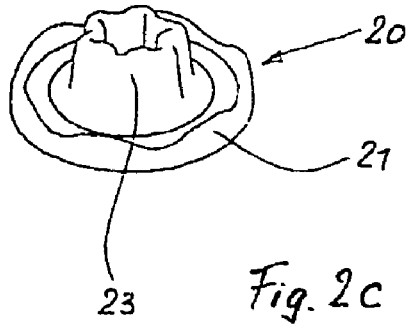
Fig. 2c

Fig. 3
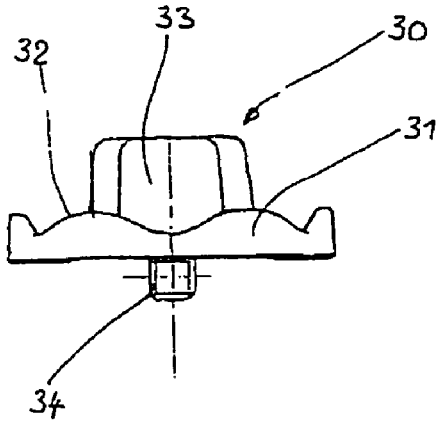
Fig. 3b
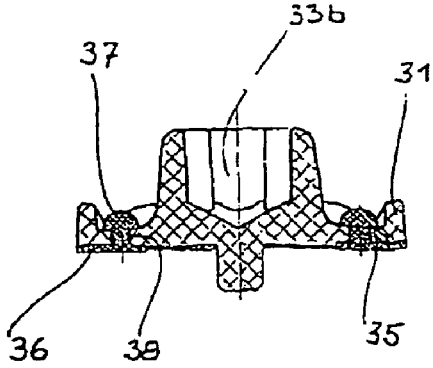
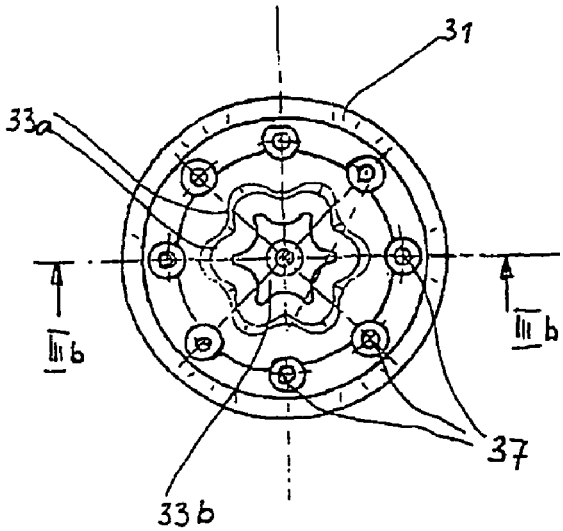
Fig. 3a
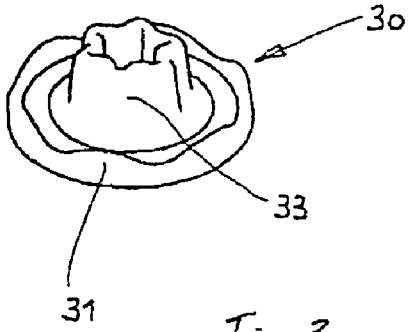
Fig. 3c

PROTECTIVE CAP FOR A SEALING STOPPER IN A COLLECTING VESSEL OF A CONDENSER

The invention relates to a condenser having a collecting vessel and to a protective cap for such a condenser in particular having a collecting vessel or collector.

DE-A 100 39 260 has disclosed a collecting vessel having a releasable sealing closure for a condenser of a motor vehicle air conditioning system. The sealing closure takes the form of a plunger-like stopper and is fixed and secured in relation to the tubular collecting vessel by means of a securing ring. Such a condenser is generally fitted in the front area of the engine compartment of a motor vehicle and is therefore exposed to dirt and spray water, which can lead to corrosion of the securing ring and of the sealing stopper in the collecting vessel. As a result it may happen that the sealing stopper becomes difficult if not impossible to remove from the collecting vessel for repair purposes. The ingress of spray water and in particular saline spray water during the winter months may also result in more serious corrosion, possibly resulting in leakages.

An object of the present invention is therefore to create a condenser and a protective cap, which will ensure secure and durable sealing of the collecting vessel against dirt and moisture.

This object is achieved by the features of claim 1 and claim 24.

The protective cap is advantageously made from plastic, preferably from a polyamide (PA), that is to say a relatively stable plastic that can be injection molded. In addition this plastic cap advantageously has a threaded plug facing the inside of the vessel, or some other fixing facility, such as a plug-in socket connection, which can be screwed into or received into a corresponding internal thread or a corresponding seat in the sealing stopper of the vessel or into the vessel itself. This affords the advantage that the necessary sealing force between the protective cap and the vessel, that is to say a strong, durable sealing effect is achieved whilst at the same time ensuring that the protective cap cannot become detached and lost.

Advantageous developments of the invention are set forth in the dependent claims. Thus the protective cap has a sealing flange having a plane sealing face, which is pressed against the end face of the collecting vessel. The contact pressure afforded by the tread and the rigidity of the protective cap mean that a strong, durable sealing effect is obtained. A seal may also be fitted of the type in which a sealing lip bears against the inside wall of the tubular vessel.

In a further development of the invention a conical concave surface, which permits a certain resilient travel of the protective cap when screwing in the threaded plug, thereby pre-tensioning the sealing flange, is provided between the outer sealing flange and the inner threaded plug. This enhances the sealing effect.

According to an advantageous further embodiment of the invention a profiled knob or a profiled depression for the engagement of a knob, which allows the protective cap to be for example manually screwed in and tightened, is provided on the outside of the protective cap. The knob advantageously has an approximately star-shaped or hexagonal profile both externally and internally, so that if necessary a correspondingly profiled tool can also be applied internally. The protective cap with knob and threaded plug can be readily manufactured by plastic injection molding.

According to a further advantageous development of the invention the sealing flange has an outwardly raised, peripheral, preferably undulating edge. This reinforces the sealing flange in the area of the sealing face, thereby increasing the contact pressure and hence the sealing effect.

In a further development of the invention a rubber sealing plate, which is preferably buttoned into corresponding holes in the sealing flange, is fixed to the plastic protective cap. The sealing plate is thereby securely connected to the plastic protective cap. Since the rubber plate is softer and more pliable than the plastic of the protective cap, the sealing effect is improved and minor irregularities in the surface of the end face of the collecting vessel are compensated for by the rubber plate.

Finally, in a further development of the invention a peripheral sealing lip, which bears against the inside wall of the collecting vessel, thereby enhancing the sealing effect yet further, is molded onto the plastic cap.

Figure 4:
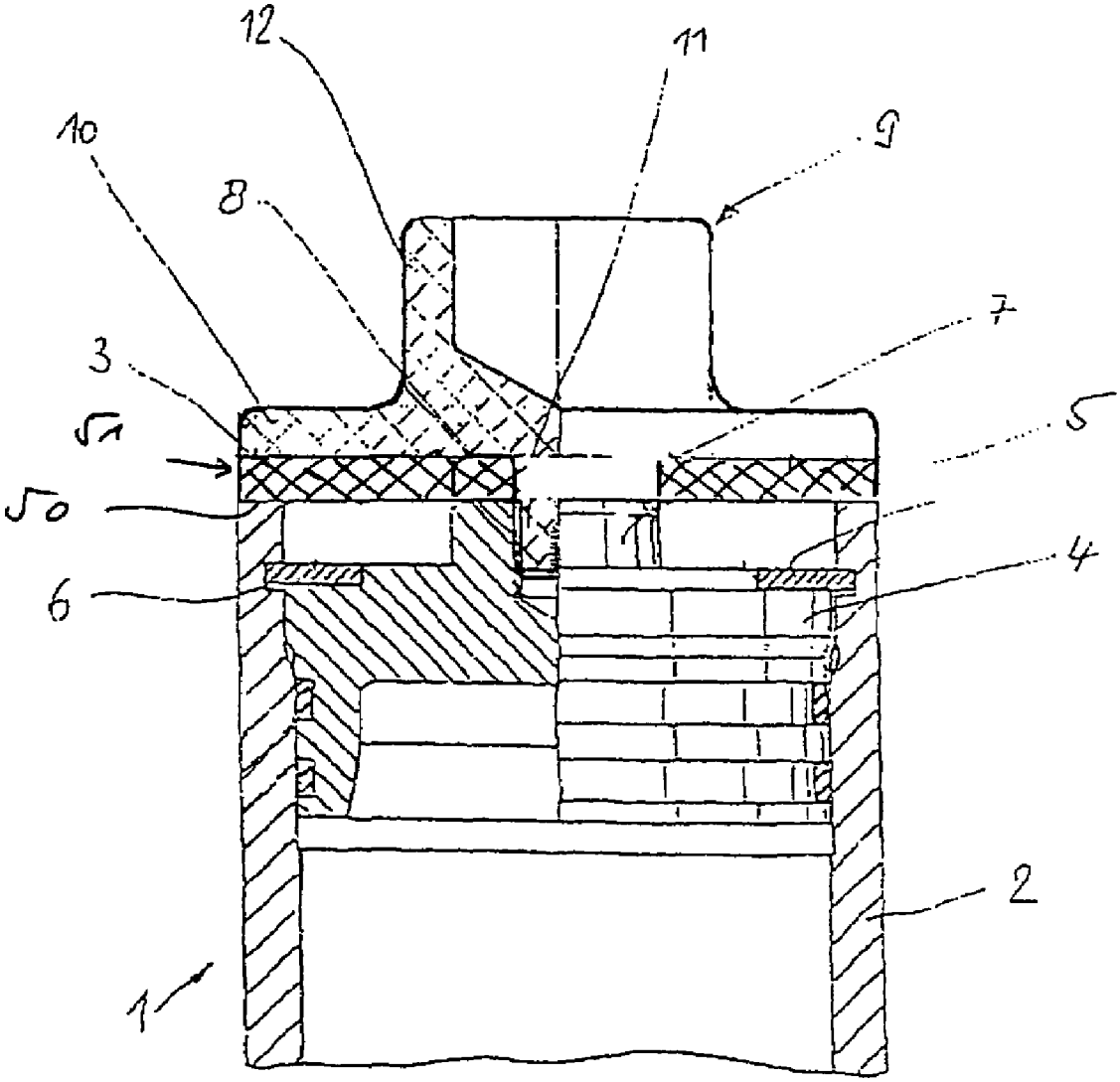
Figure 5:
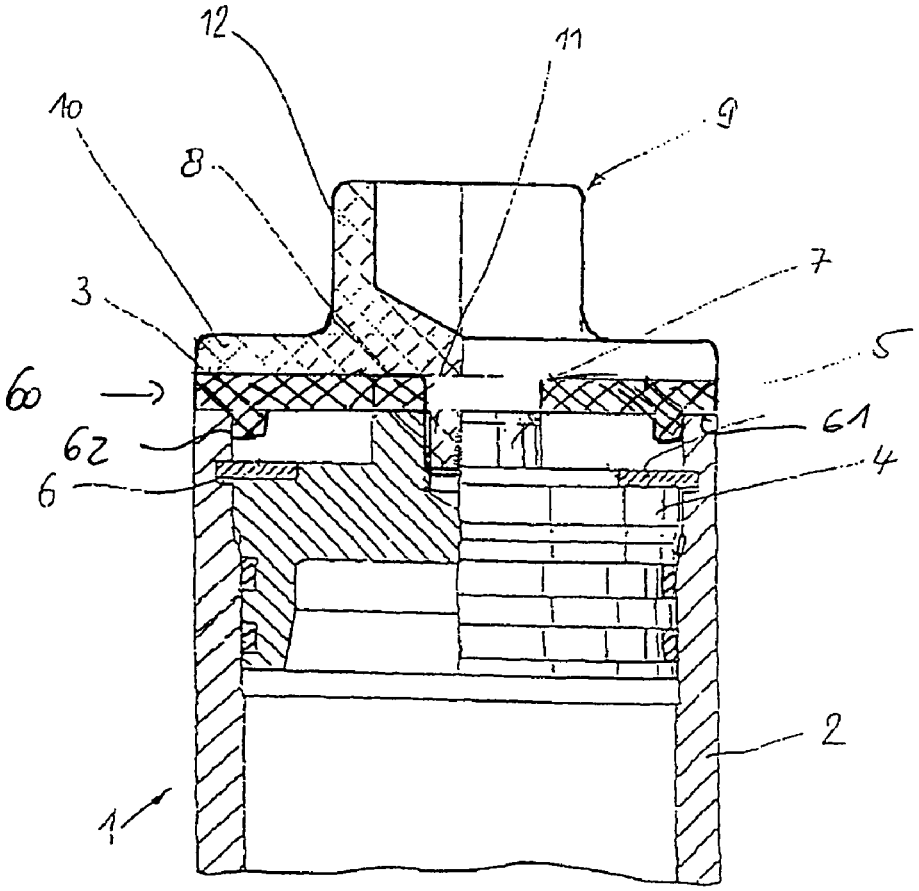

Exemplary embodiments of the invention are represented in the drawing and are described in more detail below. In the drawing FIG. 1 shows a protective cap according to the invention on a collecting vessel, FIG. 2 shows a first embodiment of the protective cap, FIG. 2*a* shows a top view of the protective cap according to FIG. 2, FIG. 2*b* shows a longitudinal section through the protective cap along the section plane IIb-IIb in FIG. 2*a*, FIG. 2*c* shows a perspective view of the protective cap according to FIG. 2, FIG. 3 shows a second embodiment of the protective cap with additional rubber seal, FIG. 3*a* shows a top view of the protective cap according to FIG. 3, FIG. 3*b* shows a longitudinal section through the protective cap along the section plane IIIb-IIIb in FIG. 3*a*, FIG. 3*c* shows a perspective view of the protective cap according to FIG. 3, FIG. 4 shows a protective cap according to the invention on a collecting vessel and FIG. 5 shows a protective cap according to the invention on a collecting vessel.

FIG. 1 shows the upper part of a collecting vessel of a condenser, as disclosed by DE-A 100 39 260 cited in the introductory part. The disclosure of DE 100 39 260 is hereby expressly incorporated into the content of the present application. A collecting vessel 1 comprises, for example, a basically circular cylindrical tube 2, which terminates in an end face 3. The tube 2 is sealed off, for example, by a releasable sealing stopper 4, which is axially fixed by a securing ring 5 held in an annular groove 6. As stated in the aforementioned published patent application, the sealing stopper can be withdrawn from the collecting vessel 1 by releasing the securing ring 5, for example for repair or servicing purposes. The sealing stopper 4 has a central projection 7, in which a threaded blind hole 8 is arranged. A protective cap 9, which has a sealing flange 10, a threaded plug 11 and a knob 12, is fitted to the end face 3 of the tube 2. The threaded plug 11 is screwed into the threaded blind hole 8, so that the pre-tensioned sealing flange 10 rests on the end face 3 of the tube 2. The protective cap 9 is of one-piece design construction and is injection molded from a plastic material, preferably from a polyamide.

The condenser suitably has a tube-and-fin block, which is arranged between two collecting pipes. The tubes of the tube-and fin blocks are at the same time tightly soldered to the collecting pipes and form flow ducts. Depending on the embodiment of the condenser, dividing walls, which produce a serpentine flow path through the tube-and-fin block, are arranged in the collecting pipes. At the same time multiple tubes can be connected in parallel for each passage through the tube-and-fin block. The number of tubes per passage suitably varies. In addition to one of the collecting pipes a collector with a vessel is provided, through which the condensed refrigerant flows.

FIG. 2 shows an exemplary embodiment of a protective cap 20 in a first embodiment. A peripheral sealing flange 21 has a plane sealing face 22, which together with the end face 3 (FIG. 1) forms a pair of sealing surfaces. On its upper side the protective cap 20 has a centrally arranged knob 23, and on its bottom side a threaded plug 24.

FIG. 2*a* shows a top view of the protective cap 20 according to FIG. 2, having the peripheral sealing flange 21 and a cavity 26 having a star-shaped profile. The external contour of the knob 23 is characterized by two lines 23*a* running parallel to one another; this produces a "grippable" periphery, which makes it easier to screw in and out manually. If necessary, a correspondingly profiled tool may be inserted into the cavity 26 with a star-shaped profile, in order to increase the tightening torque or the release torque. On its radially outer side the protective cap has a reinforced annular area 21*a*, which is intended to increase the rigidity of the protective cap. The annular area 21*a* may advantageously have an irregular height, as can be seen from FIG. 2. The areas having the greatest height are denoted by 21*b*.

FIG. 2*b* shows a section through the protective cap 20 along the plane IIb-IIb in FIG. 2*a*. A conical concave surface 25 is arranged between the outer, circular sealing face 22 and the coaxially arranged threaded plug 24. The knob 23 has the profiled cavity 26 in the form of a blind hole. From the cross-section it will be clear that the protective cap 20 can be injection molded as a one-piece plastic part. Between the radially outer sealing face and the plug an area 25 can be seen, which is recessed in relation to the sealing face. This serves to make the sealing face at least slightly resilient in an axial direction.

In order to complete the picture, FIG. 2*c* shows an isometric representation of the protective cap 20, looking towards the sealing flange 21 and the knob or turning grip 23.

FIG. 3 shows a further embodiment of a protective cap 30 having a raised edge 31, which has an undulating contour 32. As in the previous exemplary embodiment according to FIG. 2, this protective cap 30 also has a turning grip 33 and a coaxially arranged threaded plug 34.

FIG. 3*a* shows a top view of the protective cap 30 with peripheral edge 31 and protrusions 37 of the sealing plate 36 distributed over the circumference. In its external contour 33*a* and the cavity 33*b*, the turning grip 33 corresponds to the previous embodiment according to FIG. 2.

FIG. 3*b* shows a section through the protective cap 30 in the plane IIIb-IIIb in FIG. 3*a*. The raised edge 31 forms an approximate right-angle with the sealing flange 35, so that the moment of resistance of the flange 35 is increased. Connected to the sealing flange 35 is a circular sealing plate 36, which has mushroom-like protrusions 37, which are inserted or "buttoned" into corresponding holes 38 in the sealing flange 35. This means that the rubber sealing plate 36 is securely and tightly connected to the protective cap 30. The rubber material of the sealing plate 36 is softer than the plastic or polyamide material of the protective cap 30. When the protective cap 30 is inserted into the collecting vessel 1 the sealing plate 36 rests on the end face 3 thereof (cf. FIG. 1).

The sealing face with the sealing flange is advantageously molded as a 2-component element.

For the sake of completeness FIG. 3*c* shows an isometric representation of the protective cap 30 looking towards the peripheral edge 31 and the turning grip 33.

FIG. 4 shows a protective cap according to FIG. 1, the sealing face 50 taking the form of a sealing ring 51, which is assembled together with the protective cap. In this case the sealing ring has a central opening to receive the plug 7.

FIG. 5 shows a further protective cap according to the invention as shown in FIG. 1, the sealing ring 60 having a first sealing face 61 and a second sealing face 62. The sealing face 61 is basically formed on the end face and rests on the end face of the tube of the collecting vessel. The sealing face 62 basically takes the form of a cylindrical shell and rests on the inner circumferential surface of the tube of the collecting vessel.

According to the exemplary embodiment it may also be appropriate to provide just the sealing face 62 alone in order to seal off the collecting vessel.

The invention claimed is:

1. A protective cap for sealing off the end face of a collecting vessel of a condenser closed by means of a sealing stopper, the collecting vessel having a tube wall projecting above the sealing stopper, wherein the protective cap is made from a plastic material and is arranged in such a way that it seals off the collecting vessel in the area of the end of the tube wall projecting above the protective cap, wherein the protective cap comprises a sealing face and wherein the sealing face and the protective cap are of a two-part design.

2. The protective cap as claimed in claim 1, wherein the sealing face of the protective cap further comprises a substantially planar annular face, which rests on the end annular face of the tube wall and seals off the collecting vessel.

3. The protective cap as claimed in claim 1, wherein the sealing face of the protective cap further comprises an annular face, which rests on the peripheral inner circumferential surface of the tube wall and seals off the collecting vessel.

4. The protective cap as claimed in claim 1, wherein the protective cap further comprises a gripping means, which interacts with a gripping means of the sealing stopper or the tube wall and is connected thereto.

5. The protective cap as claimed in claim 1, wherein the protective cap further comprises a plug, which engages in a seat of the sealing stopper or of the tube wall.

6. The protective cap as claimed in claim 1, wherein the protective cap further comprises a seat, in which a plug of the sealing stopper or of the tube wall engages.

7. The protective cap as claimed in claim 5, wherein the plug further comprises a thread, such as an external thread, which engages in an internal thread of the seat.

8. The protective cap as claimed in claim 1, wherein the plastic is a polyamide, which may be reinforced by a fiber admixture.

9. The protective cap as claimed in claim 1, further comprising a peripheral sealing flange comprising a planar sealing face for bearing on the end face of the tube wall.

10. The protective cap as claimed in claim 1, further comprising a peripheral sealing flange comprising a cylindrical sealing face for bearing on the inner circumferential surface of the tube wall.

11. The protective cap as claimed in claim 1, wherein the sealing face is connected as an annular element to the protective cap.

12. The protective cap as claimed in claim 1, wherein the sealing face is formed in one piece as an annular element together with the protective cap.

13. A protective cap for sealing off the end face of a collecting vessel of a condenser closed by means of a sealing stopper, the collecting vessel having a tube wall projecting above the sealing stopper, wherein the protective cap is made from a plastic material and is arranged in such a way that it seals off the collecting vessel in the area of the end of the tube wall projecting above the protective cap and wherein the protective cap comprises a sealing face which comprises an elastic material.

14. The protective cap as claimed in claim 1, characterized in that the sealing face is braced by way of the plug against the end face of the tube wall or the inner circumferential surface of the tube wall.

15. A protective cap for sealing off the end face of a collecting vessel of a condenser closed by means of a sealing stopper, the collecting vessel having a tube wall projecting above the sealing stopper, wherein the protective cap is made from a plastic material and is arranged in such a way that it seals off the collecting vessel in the area of the end of the tube wall projecting above the protective cap and wherein the protective cap comprises a threaded plug and a sealing face and further comprises a circular, conical concave surface which is arranged between the threaded plug and the sealing face.

16. The protective cap as claimed in claim 1, further comprising a centrally arranged, profiled knob.

17. The protective cap as claimed in claim 16, wherein the knob is of hollow design construction and has an outwardly open blind hole having an approximately star-shaped cross-section.

18. A protective cap for sealing off the end face of a collecting vessel of a condenser closed by means of a sealing stopper, the collecting vessel having a tube wall projecting above the sealing stopper, wherein the protective cap is made from a plastic material and is arranged in such a way that it seals off the collecting vessel in the area of the end of the tube wall projecting above the protective cap and wherein the protective cap comprises a sealing flange which comprises a peripheral, raised edge.

19. The protective cap as claimed in claim 18, wherein the edge has an undulating upper edge.

20. A protective cap for sealing off the end face of a collecting vessel of a condenser closed by means of a sealing stopper, the collecting vessel having a tube wall projecting above the sealing stopper, wherein the protective cap is made from a plastic material and is arranged in such a way that it seals off the collecting vessel in the area of the end of the tube wall projecting above the protective cap and wherein the protective cap comprises a sealing flange and a rubber sealing plate, connected to the protective cap, and arranged on the sealing flange.

21. The protective cap as claimed in claim 20, wherein the sealing plate is buttoned or molded by means of protrusions into holes in the flange.

22. A protective cap for sealing off the end face of a collecting vessel of a condenser closed by means of a sealing stopper, the collecting vessel having a tube wall projecting above the sealing stopper, wherein the protective cap is made from a plastic material and is arranged in such a way that it seals off the collecting vessel in the area of the end of the tube wall projecting above the protective cap and wherein the protective cap comprises a sealing flange and a peripheral sealing lip which is molded onto the sealing flange.

23. A condenser comprising a collecting vessel with a protective cap according to claim 1.

24. The protective cap as claimed in claim 13, wherein the elastic material comprises an elastomer.

* * * * *